US006599097B2

(12) United States Patent
Kim

(10) Patent No.: US 6,599,097 B2
(45) Date of Patent: Jul. 29, 2003

(54) DRY VACUUM PUMP WITH IMPROVED GAS DISCHARGING SPEED AND PUMP COOLING

(75) Inventor: Deok-Kyeom Kim, Incheon (KR)

(73) Assignee: Woosung Vacuum Co., Ltd., Incheon (KR)

( * ) Notice: Subject to any disclaimer, the term of this patent is extended or adjusted under 35 U.S.C. 154(b) by 0 days.

(21) Appl. No.: 09/969,097

(22) Filed: Oct. 3, 2001

(65) Prior Publication Data

US 2003/0035731 A1 Feb. 20, 2003

(30) Foreign Application Priority Data

Aug. 14, 2001 (KR) ..... 2001-48907

(51) Int. Cl.[7] ..... F04B 23/08
(52) U.S. Cl. ..... 417/205; 417/373; 417/418.3
(58) Field of Search ..... 417/199.1, 205, 417/372, 373, 410.3, 410.4, 418.3; 418/3, 85, 88, 96

(56) References Cited

U.S. PATENT DOCUMENTS

| | | | | |
|---|---|---|---|---|
| 2,691,482 A | | 10/1954 | Ungar | |
| 3,424,373 A | | 1/1969 | Gardner | |
| 4,366,834 A | | 1/1983 | Hanson et al. | |
| 4,483,667 A | | 11/1984 | Berges et al. | |
| 4,525,129 A | | 6/1985 | Berges et al. | |
| 4,767,284 A | * | 8/1988 | Shiinoki et al. | 417/312 |
| 4,808,095 A | * | 2/1989 | Nishitani et al. | 418/15 |
| 4,844,702 A | | 7/1989 | Ceccherini et al. | |
| 5,020,976 A | | 6/1991 | Nakajima et al. | |
| 5,118,251 A | * | 6/1992 | Saulgeot | 415/90 |
| 5,236,313 A | | 8/1993 | Kim | |
| 5,667,370 A | | 9/1997 | Im | |

FOREIGN PATENT DOCUMENTS

JP 402259295 A * 10/1990

* cited by examiner

*Primary Examiner*—Charles G. Freay
*Assistant Examiner*—John F Belena
(74) *Attorney, Agent, or Firm*—Birch, Stewart, Kolasch & Birch, LLP

(57) ABSTRACT

The present invention relates to a dry vacuum pump which includes multiple-tier cylinders, a gas flow path formed in a cover, and a cooling water flow path for thereby concurrently a heat of cooling rotation friction elements and a high temperature gas. In order to implement the present invention, in a dry vacuum pump, a cooling water inlet is formed in an outer surface of the rear cover, a cooling water outlet is formed in the front cover, and a cooling flow path is formed for guiding the cooling water flown through the cooling water inlet to circulate in each cylinder and intermediate cover, and in addition the cooling water flow path is formed in the inner and outer sides of the gas flow path formed in the rear cover and intermediate cover in a circular shape, and the cooling water flow paths which are formed in the inner and outer sides of the gas flow path are connected by a flow pipe which passes through the gas flow path for thereby concurrently cooling a gas flow path and the portions of a rotary shaft by a cooling water which flows through the cooling water flow path.

15 Claims, 8 Drawing Sheets

[Fig.1]
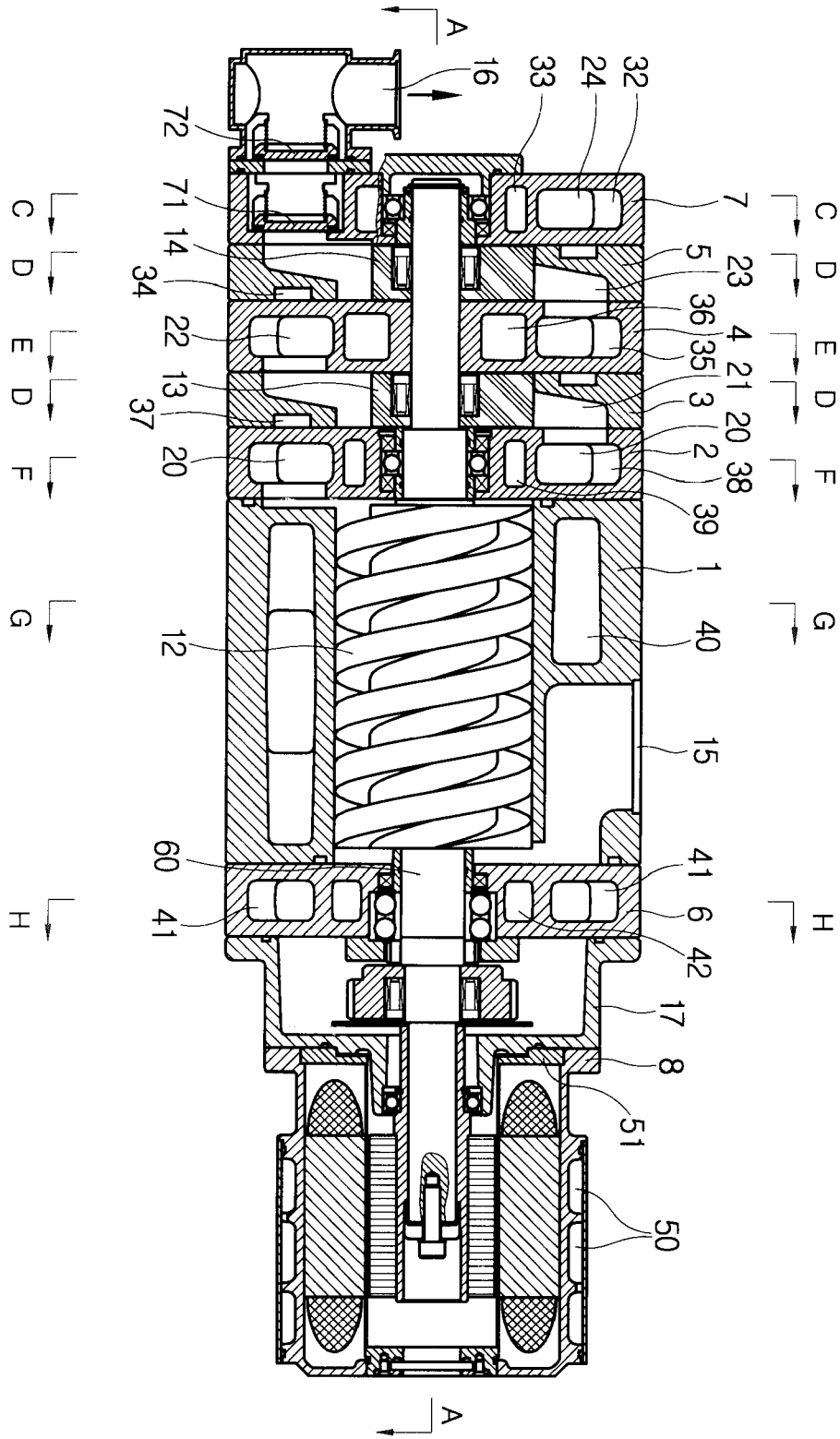

[Fig.2]
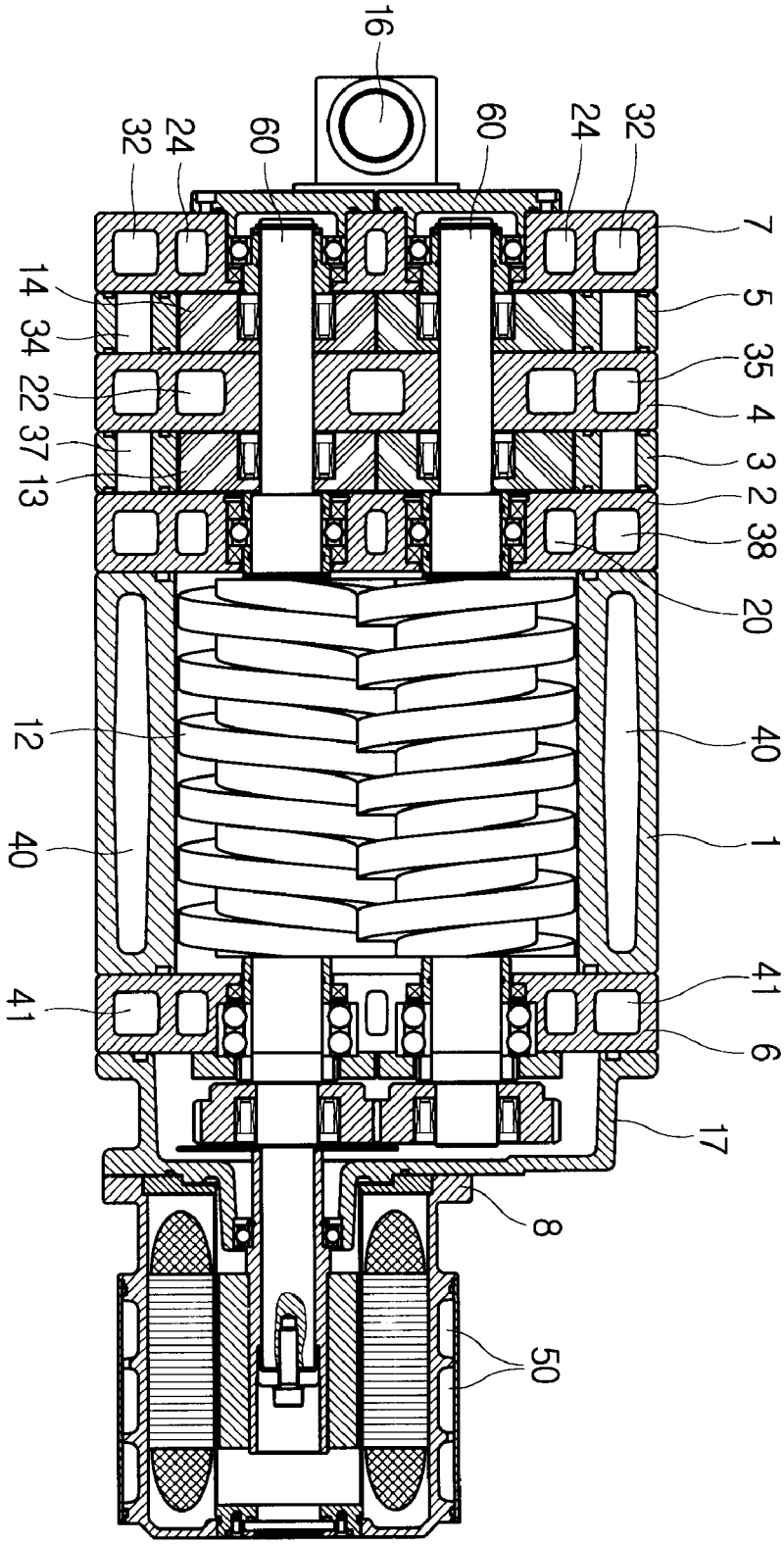

[Fig.3]
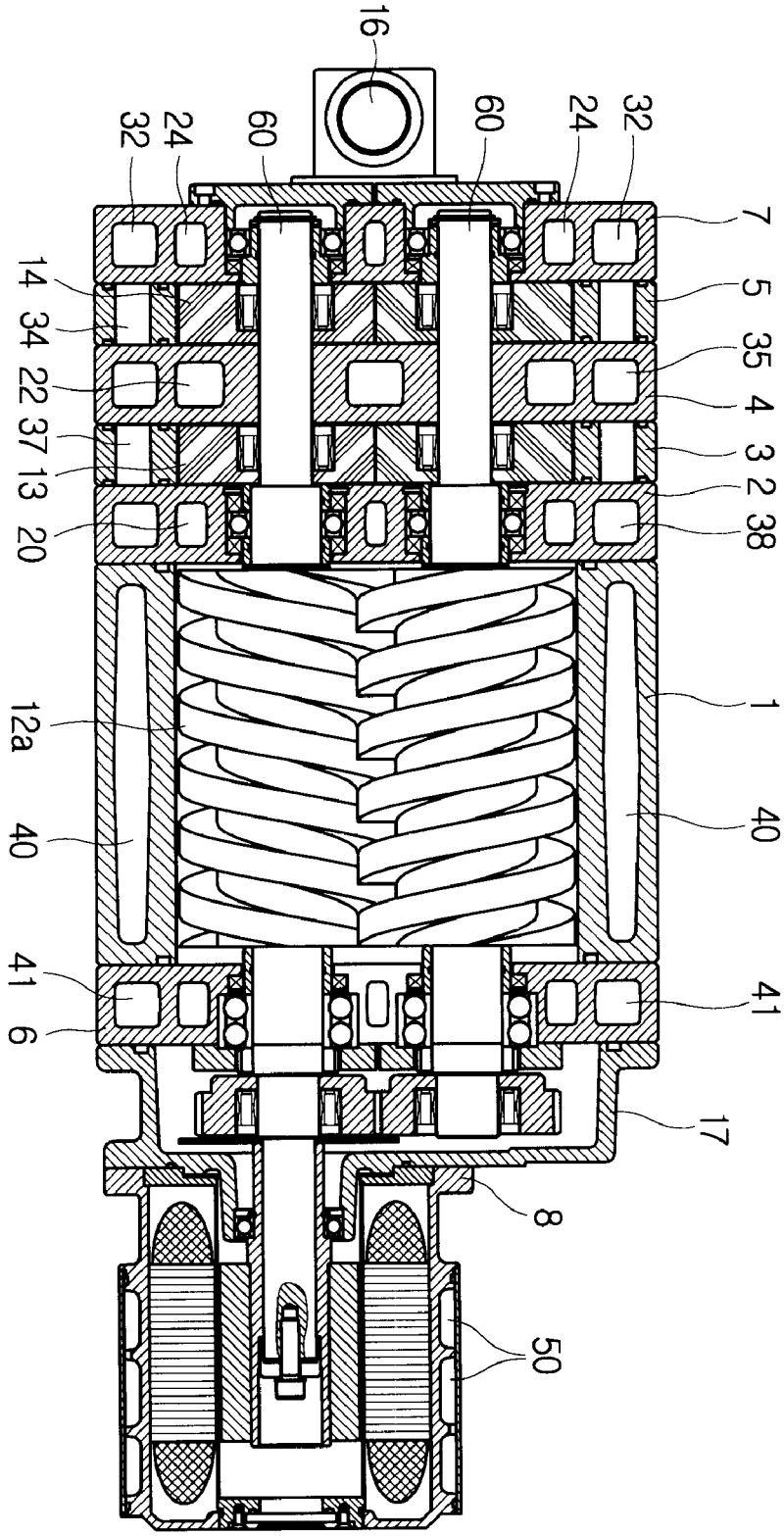

[Fig.4]
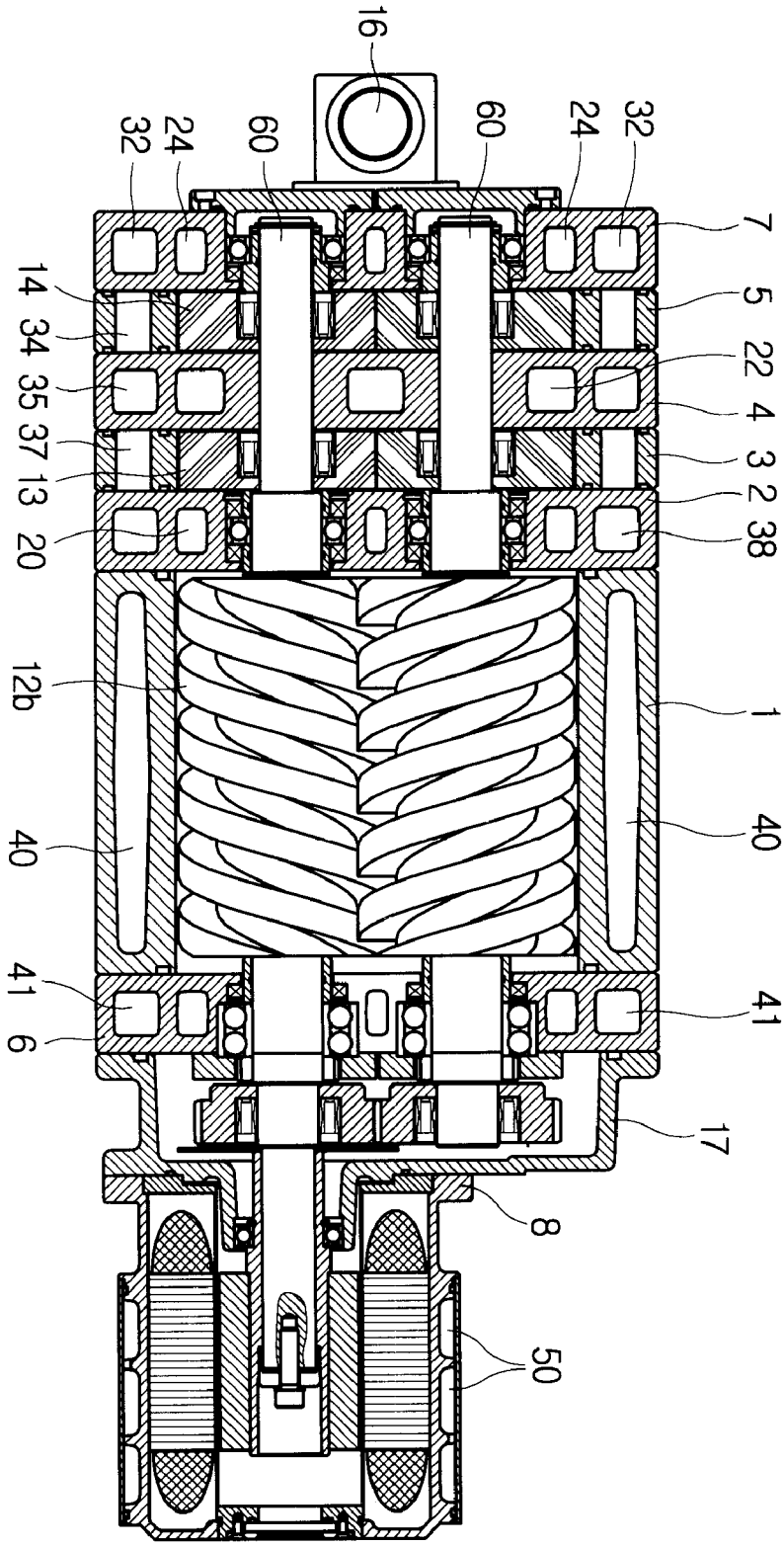

[Fig.5]
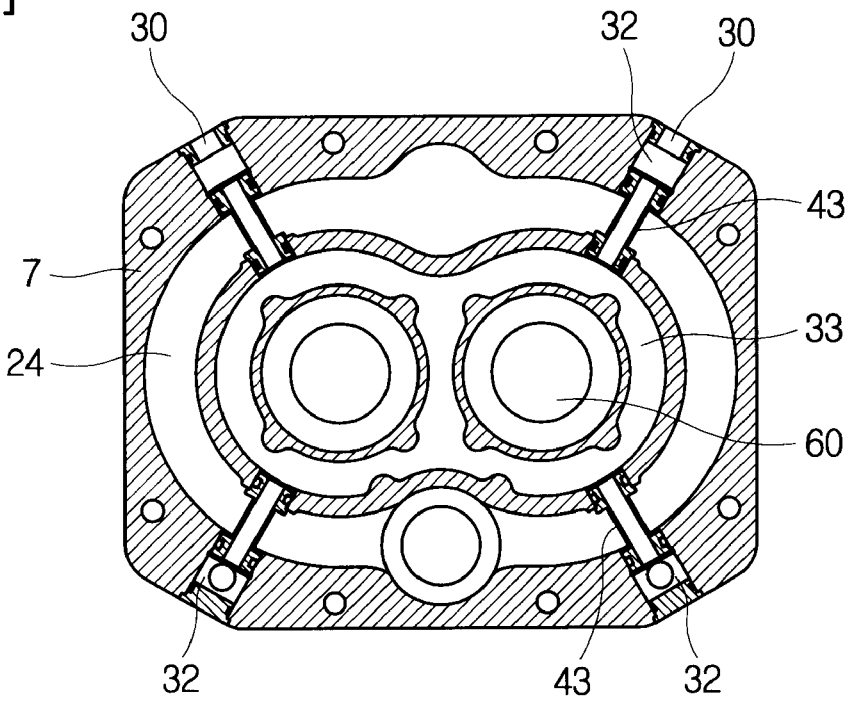
[Fig.6]
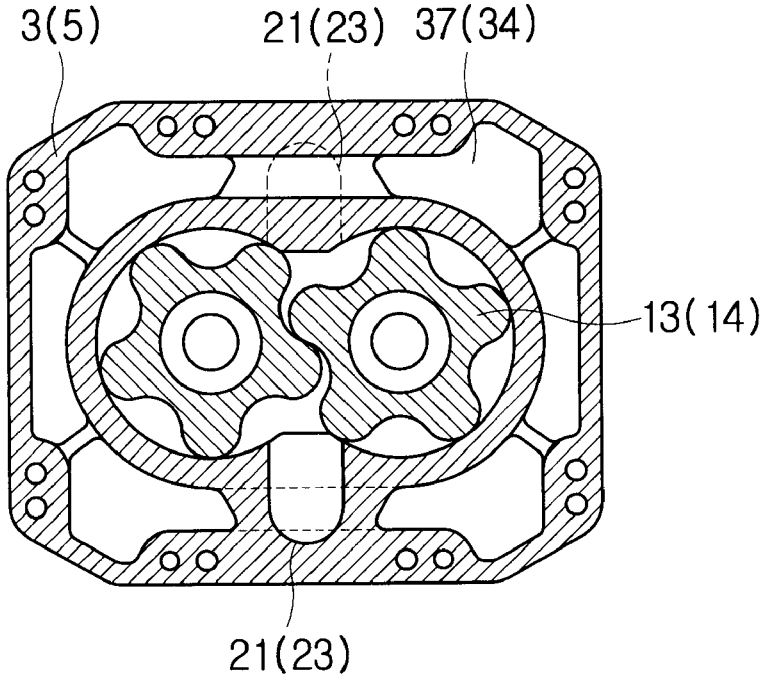

[Fig.7]
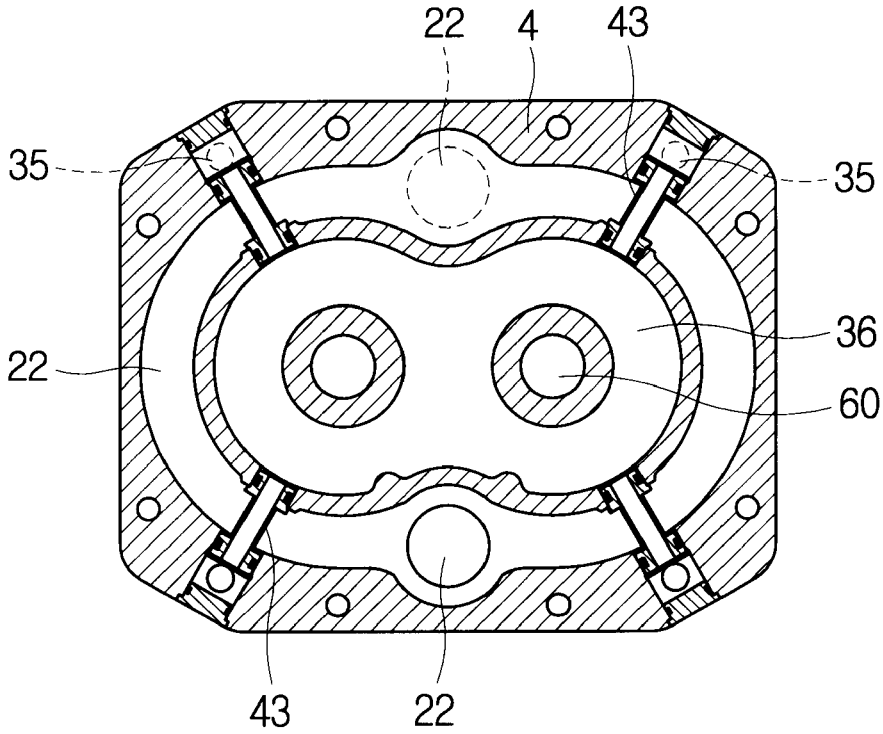
[Fig.8]
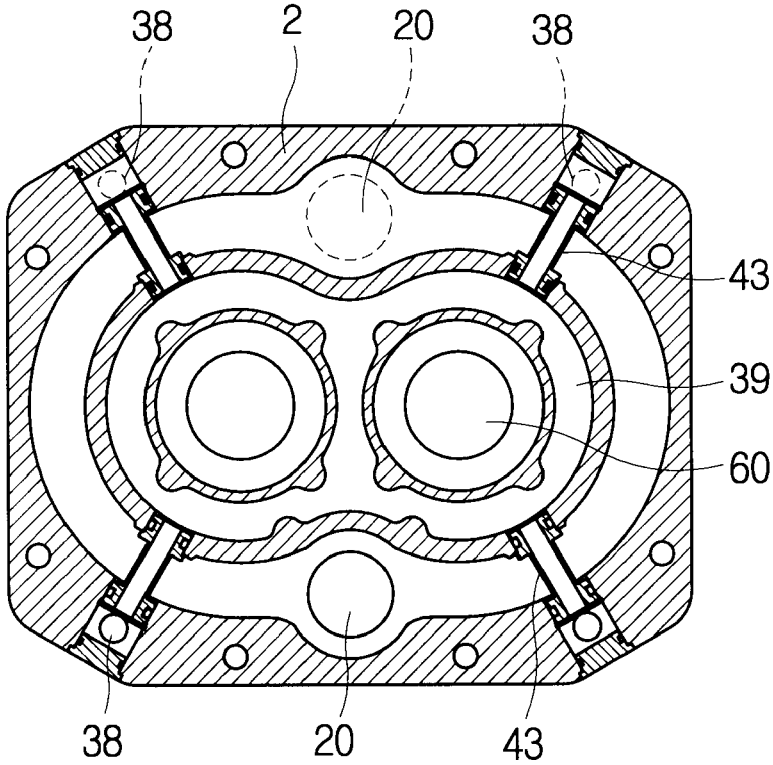

[Fig.9]
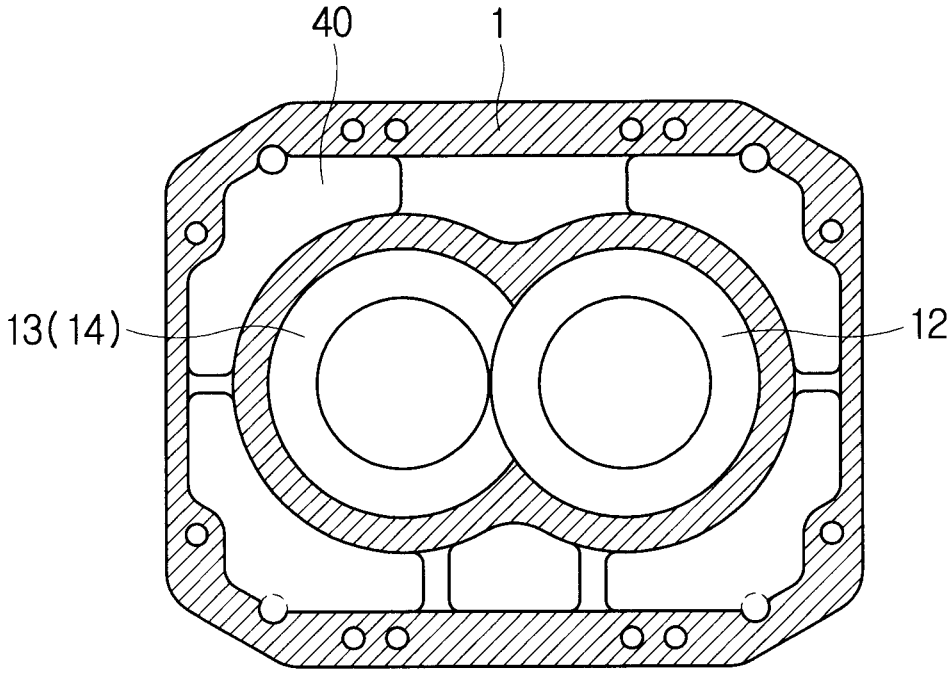
[Fig.10]
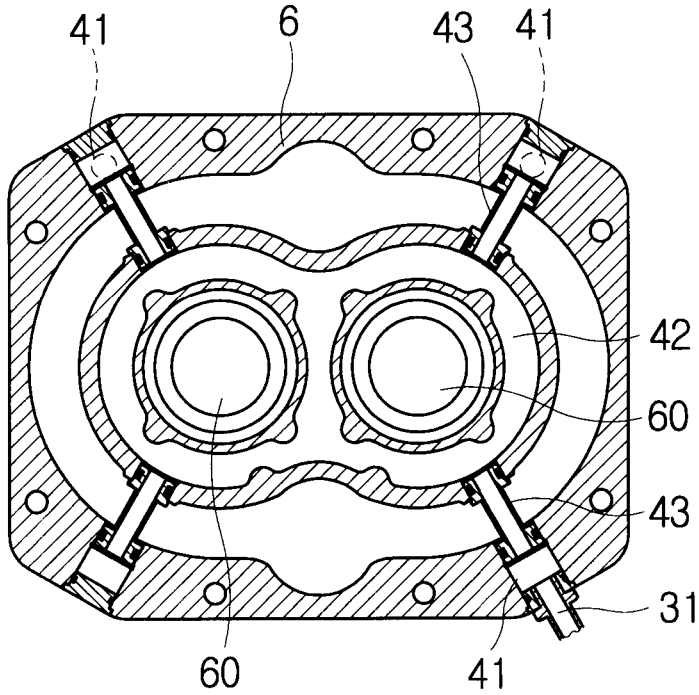

[Fig.11]
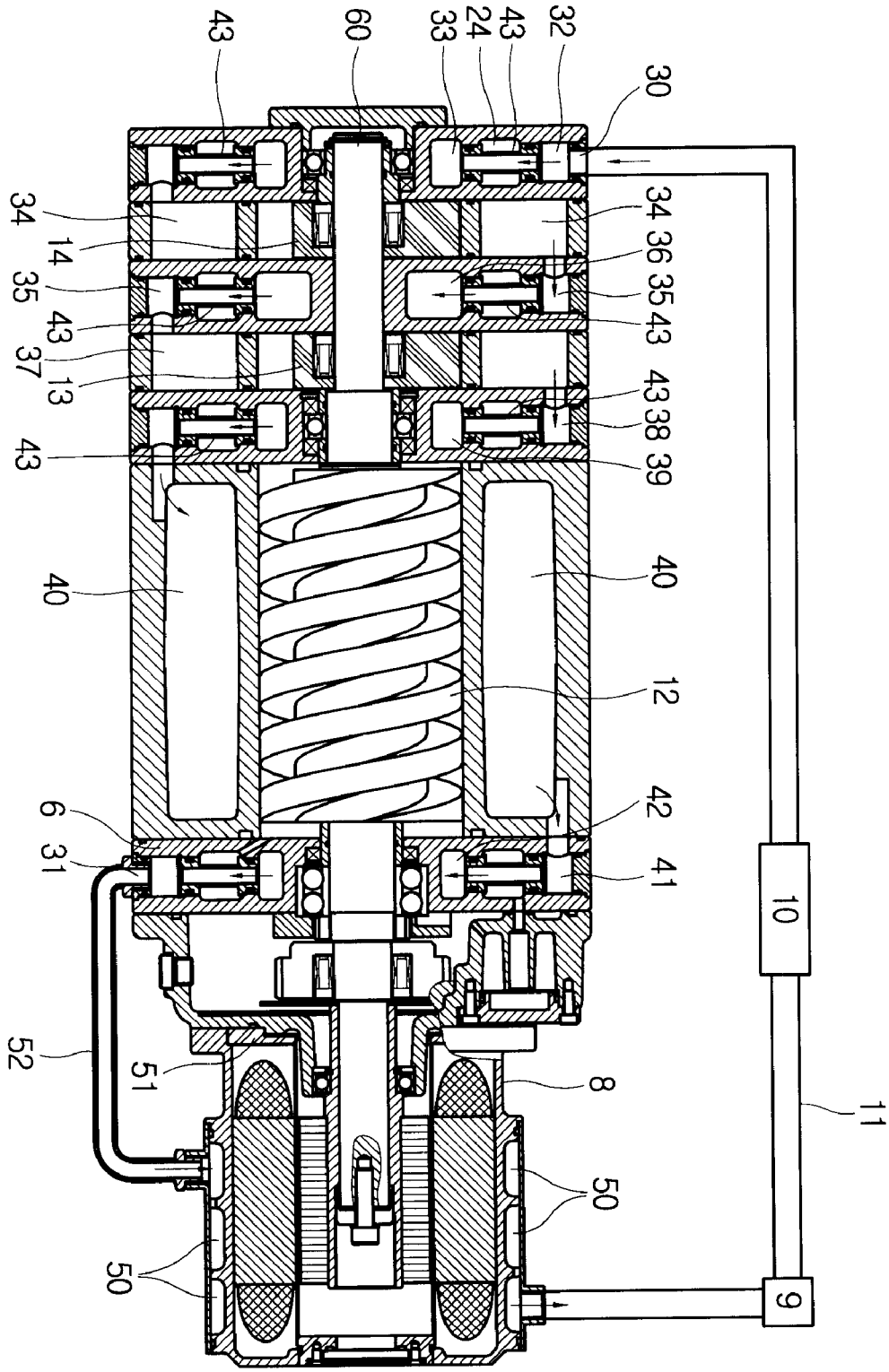

DRY VACUUM PUMP WITH IMPROVED GAS DISCHARGING SPEED AND PUMP COOLING

BACKGROUND OF THE INVENTION

1. Field of the Invention

The present invention relates to a dry vacuum pump, and in particular to an improved dry vacuum pump which is capable of increasing a discharging speed of a gas compressed and discharged, adjusting a vacuum degree of a vacuum pump and concurrently cooling a friction element of a vacuum pump and a gas pumped.

2. Description of the Background Art

In a screw type vacuum pump, a pair of screws are installed in the interior of a cylinder. A gas is drawn in from a vacuum facility and is compressed as the screws are engaged and rotated. The compressed gas is discharged to the outside, thereby implementing a vacuum state within the gas pump. In order to quickly obtain a high vacuum state, a plurality of sub-vacuum pumps each having a rotor are continuously installed in such a manner that a compression ratio of the same is gradually increased in the direction of an outlet. In the above vacuum pump, a high temperature heat is generated in a screw and a bearing portion that supports a rotary shaft of a rotor. When the gas is compressed to a high pressure state, since the gas causes the surrounding components to become over-heated, various friction elements which form a vacuum pump are easily degraded and worn-out, so that a durability of the system is decreased.

In order to overcome the above problems, in the conventional vacuum pump, a cooling water flow path is formed outside a gas flow path formed in the interior of the cylinder, so that the temperature of the gas which flows through the gas flow path is cooled by cooling water which circulates through a cooling water flow path.

In the above method, the operation for cooling a high temperature compression gas which flows through the gas flow path is effective. However, since the cooling water flow path is distanced from the portion of the rotary shaft, the portions of the rotary shaft in which a high friction heat is generated due to a high speed rotation member, e.g., such as bearing, are not effectively cooled.

In addition, in the conventional vacuum pump, since the screw has an one-line threaded portion, it is impossible to increase the discharging speed of the gas pumped from the vacuum pump. Since it is impossible to vary the vacuum degree of the vacuum pump based on a pumping situation, it is impossible to implement a desired performance of the vacuum pump in which a high vacuum degree must be obtained during a short pumping time.

Accordingly, it is an object of the present invention to provide a dry vacuum pump that overcomes the problems encountered in a conventional cylindrical pump housing structure.

It is another object of the present invention to provide a dry vacuum pump which is capable of increasing a discharging speed of a gas which is compressed and discharged by forming a threaded portion of a main screw in multiple portions, sequentially installing a plurality of cylinders each having a gas discharging rotor as a sub-vacuum pump in a rear end of a cylinder having a main screw for thereby adjusting a vacuum degree of a vacuum pump and forming a cooling water flow path between shafts which form a vacuum pump for thereby concurrently cooling or offsetting heat generated in a rotation friction element of a vacuum pump and a high temperature gas which is pumped.

To achieve the above object, there is provided a dry vacuum pump comprising a first cylinder and a second cylinder being installed between a front cover and a rear cover in a tier-structure; an intermediate cover being formed between the first and the second cylinders; a main screw being installed in the first cylinder for compressing and discharging a gas of a vacuum facility; a rotor being formed in the second cylinder for drawing, compressing, and discharging the gas compressed by the main screw; a gas flow path being formed between the intermediate cover and the second cylinder for compressing and discharging the gas; a motor housing engaging the front cover; a cooling water inlet being formed within an outer surface of the rear cover of the dry vacuum pump; a cooling water outlet being formed within the front cover; a cooling flow path being formed for guiding the cooling water pumped through the cooling water inlet to circulate in each cylinder and intermediate cover; wherein the cooling water flow path is formed in an inner and an outer side of the gas flow path formed in the rear cover and intermediate cover and in a circular shape; and a flow pipe, wherein the cooling water flow path which is formed in the inner and outer sides of the gas flow path is connected by the flow pipe which passes through the gas flow path for thereby concurrently cooling the gas flow path and portions of a rotary shaft by a cooling water which flows through the cooling water flow path.

In the present invention, a threaded portion of the main screw is formed with multiple threads for thereby increasing a discharging speed of the gas pumped.

In addition, a cooling water circulation hole is formed in an outer portion of the motor housing in a screw shape, and one side of the cooling water circulation hole is connected with the cooling water outlet of the front cover through a connection pipe, and the other side of the cooling water circulation hole is connected with a water pump through a cooling water flow pipe.

BRIEF DESCRIPTION OF THE DRAWINGS

The present invention will become better understood with reference to the accompanying drawings which are given only by way of illustration and thus are not limitative of the present invention, wherein;

FIG. 1 is a cross-sectional view illustrating a dry vacuum pump according to the present invention;

FIG. 2 is a cross-sectional view taken along line A—A of FIG. 1;

FIG. 3 is a view illustrating a state that a screw having a two-line threaded portion is engaged according to the present invention;

FIG. 4 is a view illustrating a state that a screw having a three-line threaded portion is engaged according to the present invention;

FIG. 5 is a cross-sectional view taken along line C—C of FIG. 1;

FIG. 6 is a cross-sectional view taken along line D—D of FIG. 1;

FIG. 7 is a cross-sectional view taken along line E—E of FIG. 1;

FIG. 8 is a cross-sectional view taken along line F—F of FIG. 1;

FIG. 9 is a cross-sectional view taken along line G—G of FIG. 1;

FIG. 10 is a cross-sectional view taken along line H—H of FIG. 1; and

FIG. 11 is a cross-sectional view taken along line B—B of FIG. 5.

DETAILED DESCRIPTION OF THE PREFERRED EMBODIMENTS

The present invention will be explained with reference to FIGS. 1 through 11.

In the drawings, reference numeral 1 represents a first cylinder in which a pair of main screws 12 are installed in the interior of the first cylinder 1. A front cover 6 is engaged to one side of the first cylinder 1. A first intermediate cover 2, a second cylinder 3, a second intermediate cover 4, a third cylinder 5, and a rear cover 7 are sequentially engaged to the other side of the first cylinder, e.g., opposite of the front cover 6 with respect to the first cylinder 1. A motor fixing plate 17 is engaged to the front portion of the front cover 6, and a motor housing 8 is engaged to the motor fixing plate 17 using a bolt.

The second and third cylinders 3 and 5 are sub-vacuum pumps which include rotors 13 and 14 for enhancing a vacuum operation. In a preferred embodiment, one through 4 rotors are connected with the first cylinder 1.

In the interior of the motor housing 8, a stator of a motor is installed in the interior of a can housing 51, and the can housing 51 is engaged to the motor fixing plate 17, and the motor housing 8 is engaged to the outer portion of the same. The interior of the motor and one end of the rotary shaft 60 are separated from each other, so that a sealing member is not additionally formed in one end of the rotary shaft 60 to which the motor is engaged.

A suction port 15 is formed in the first cylinder 1 for drawing in a gas. First and second rotors 13 and 14 are installed in the interior of the second cylinder 3 and the third cylinder 5 for drawing in and discharging the gas compressed by the main screw 12.

Gas flow paths 20~24 are formed in the second and third cylinders 3 and 5 and the rear cover 7 for guiding the gas compressed and pumped by the main screw 12 to be discharged through the first rotor 13 and the second rotor 14. A discharging port 16 is formed in the rear cover 7 for lastly discharging the pumped gas.

Two opening and closing valves 71 and 72 are sequentially formed in the discharging port 16 for thereby decreasing a discharging noise generated from the discharging port 16. When the pump is stopped, a reverse flow of the gas is prevented by the opening and closing valves 71 and 72 for thereby preventing the vacuum state of the pump from being released.

Therefore, when the rotary shaft 60 is rotated by the rotation force from the motor, the main screw 12 and the first and second rotors 13 and 14 are rotated together, and the gas pumped through the suction port 15 is compressed by the main screw 12 and is discharged through the gas flow path 20, and the compressed gas pumped through the gas flow path 20 is drawn in by the first and second rotors 13 and 14 and is discharged through the discharging port 16.

In the present invention, a cooling system is provided for effectively cooling the friction elements such as bearing and the gas compressed and discharged by the main screw.

In the above cooling system, a cooling water inlet 30 is formed in an outer portion of the rear cover 7, and a cooling water outlet 31 is formed in an outer portion of the front cover 6. Cooling water flow paths 32~42 are formed in the covers 2, 4, 6, and 7 and the cylinders, 1, 3 and 5 for guiding the flow of the cooling water. A cooling water circulation hole 50 is formed in an outer surface of the motor housing in a screw shape for guiding a circulation of the cooling water in an outer portion of the motor housing 8, and the cooling water outlet 31 and the cooling water circulation hole 50 are connected by a connection pipe 52, and an outlet portion of the cooling water circulation hole 50 and the cooling water inlet 30 are connected by a cooling water pipe 11 for thereby implementing a continuous circulation of the cooling water.

A water pump 9 for circulating the cooling water and a cooling unit 10 for cooling the cooling water are sequentially installed in the intermediate portion of the cooling water pipe 11.

The cooling unit 10 is capable of implementing a radiating operation of the cooling water like a radiator.

At this time, the cooling flow paths 32, 33, 35, 36, 38, 39, 41 and 42 formed in the covers 2, 4, 6 and 7 are formed in the inner and outer portions of the gas flow paths 20, 22 and 24 formed in the covers 2, 4, 6 and 7, and the cooling water flow paths 33, 36, 39 and 42 formed in the inner side are formed in a circular shape. Since the cooling water flow paths 33, 36, 39 and 42 formed in the inner portion and the cooling water flow paths 32, 35, 38 and 41 formed in the outer portion are separated from each other by the gas flow paths 20, 22 and 24 formed in the circular shape, in order to communicate the above paths, a flow pipe 43 which passes through the gas flow paths 20, 22 and 24 connects the inner and outer cooling water flow paths.

Therefore, various friction elements like a support bearing of the rotary shaft and the gas which flows through the gas flow paths are effectively cooled by a cooling water which circulates in the cooling water paths 33, 36, 39 and 42 formed in the inner side in a circular shape, and the gas is effectively cooled by a cooling water which passes through the flow pipe 43.

FIG. 3 is a view illustrating a pump where a main screw 12*a* in which a threaded portion is formed in two threaded sections, e.g., in two lines, is adapted. As shown therein, the threaded portion of the main screw 12*a* is formed in two lines, so that the discharging speed of the gas compressed and pumped by the main screw is increased.

FIG. 4 is a view illustrating a state that a main screw 12*b* in which a threaded portion is formed in three threaded sections, e.g., in three lines, is adapted. In this embodiment, it is possible to increase the discharging speed of the gas based on the increased number of lines.

A pair of main screws are engaged by a right screw and a left screw in the cylinder 1, and the gas is drawn in and compressed. The discharging speed is determined based on the volume between the threaded portions, the main screw revolutions per second, and the number of the threaded portions based on the rotation of the main screw when the pump is rotated by one rotation. The above operation may be expressed as follows, wherein the discharging gas speed, 5, is calculated as follows:

$$\text{Equation}=S=2(V\cdot n\cdot L)$$

Where S represents a discharging speed, V represents a volume between the threaded portions when the pump is rotated by one rotation, n represents the speed of the main screw in revolutions per second, and L represents the number of threaded portions.

As seen in the above Equation, the discharging speed of the pump cylinder for a given value of N screw revolutions per second is determined based on the number of threaded portions.

Therefore, as shown in FIGS. 3 and 4, when the number of the threaded portion is increased to 2 or 3, the discharging speed of the gas is increased by 2 or 3 times in proportion to the increased number of the threaded portions.

FIG. 5 is a cross-sectional view taken along line C—C of FIG. 1. As shown therein, a rotary shaft 60 is formed in the inner center portion of the rear cover 7. A circular cooling water flow path 33, a circular gas flow path 24, an outer cooling water flow path 32 and a cooling water inlet 30 are sequentially formed in the outer potion of the rotary shaft 60. The outer cooling water flow path 32 and the inner cooling water flow path 33 are connected by the flow pipe 43 which passes through the gas flow path 24.

Therefore, the cooling water pumped through the cooling water inlet 30 is pumped to the inner cooling water flow path and is pumped to the cooling water flow path 34 of the third cylinder 5 through the cooling water flow path 32. In the above flow operation, a high temperature compression gas which passes through the gas flow path 24 is effectively cooled, and the over heating of the friction elements like the rotary shaft 60 is prevented.

FIG. 6 is a cross-sectional view taken along line D—D of FIG. 1. As shown therein, first and second rotors 13 and 14 are formed in the inner center portions of the second cylinder 3 and the third cylinder 5. The gas flow paths 21 and 23 are formed in the outer portions of the same for drawing in and discharging the gas, and the cooling water flow paths 37 and 34 are formed across the gas flow paths 21 and 23.

FIG. 7 is a cross-sectional view taken along line E—E of FIG. 1. The rotary shaft 60 is formed in the inner center potion of the second intermediate cover 4. An inner cooling water flow path 36, a circular gas flow path 22 and an outer cooling water flow path 35 are sequentially formed in an outer portion of the rotary shaft 60, and the inner cooling water flow path 36 and the outer cooling water flow path 35 are connected by the flow pipe 43 which passes through the gas flow path 22.

FIG. 8 is a cross-sectional view taken along line F—F of FIG. 1. As shown therein, the rotary shaft 60 is formed in the inner center portion of the first intermediate cover 20. A circular inner cooling water flow path 39, a circular gas flow path 20 and an outer cooling water flow path 38 are sequentially formed in an outer portion of the rotary shaft 60. The inner cooling water flow path 39 and the outer cooling water flow path 38 are connected by the flow pipe 43 which passes through the gas flow path 20.

FIG. 9 is a cross-sectional view taken along line G—G of FIG. 1. As shown therein, a pair of main screws 12 are formed in the inner center portion of the first cylinder 1, and a cooling water flow path 40 is formed in an outer portion of the same.

FIG. 10 is a cross-sectional view taken along line H—H of FIG. 1. As shown therein, a rotary shaft 60 is installed in the inner center portion of the front cover 6, and the inner and outer cooling water flow paths 42 and 41 are formed at both sides of the gas flow path in the outer portion of the rotary shaft 60. The cooling water flow paths 42 and 41 are connected by the flow pipe 43.

In addition, a cooling water outlet 31 is formed in an outer portion of the cooling water flow path 41 for discharging a cooling water to the side of the motor.

FIG. 11 is a cross-sectional view taken along line B—B of FIG. 5 and shows a plurality of cooling water flow paths, an installation position of a flow pipe, and the construction of a cooling system which are provided in the interior of the vacuum pump.

As described above, in the present invention, it is possible to increase the discharging speed of the gas which is compressed and discharged, by increasing the number of the threaded portions of the main screw. A plurality of cylinders each having a gas discharging rotor are sequentially installed in a rear portion of the cylinder in which the main screw is formed, so that it is possible to adjust the vacuum degree of the vacuum degree. A cooling water flow path is formed in an inner and outer portion of the gas flow path formed in each cylinder and cover, and the inner and outer cooling water flow paths are connected by the flow pipe which passes through the gas flow path. The friction elements of the vacuum pump and the pumped gas are concurrently cooled by a cooling water which circulates in the inner cooling water flow path formed between the rotary shaft and the gas flow path.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A dry vacuum pump comprising:

a first cylinder and a second cylinder being installed between a front cover and a rear cover in a tier-structure;

an intermediate cover being formed between the first and the second cylinders;

a main screw being installed in the first cylinder for compressing and discharging a gas of a vacuum facility;

a rotor being formed in the second cylinder for drawing, compressing, and discharging the gas compressed by the main screw;

a gas flow path being formed between the intermediate cover and the second cylinder for compressing and discharging the gas;

a motor housing engaging the front cover;

a cooling water inlet being formed within an outer surface of the rear cover of the dry vacuum pump;

a cooling water outlet being formed within the front cover;

a cooling flow path being formed for guiding a cooling water pumped through the cooling water inlet to circulate in each cylinder and intermediate cover; wherein the cooling water flow path is formed in an inner and an outer side of the gas flow path formed in the rear cover and intermediate cover and in a circular shape; and a flow pipe, wherein the cooling water flow path which is formed in the inner and outer sides of the gas flow path is connected by the flow pipe which passes through the gas flow path for thereby concurrently cooling the gas flow path and portions of a rotary shaft by a cooling water which flows through the cooling water flow path.

2. The vacuum pump according to claim 1, wherein a threaded portion of the main screw is formed having multiple threads for thereby increasing a discharging speed of the gas pumped.

3. The vacuum pump according to claim 2, further comprising a cooling water circulation hole being formed in an outer portion of the motor housing in a screw shape, wherein a first side of the cooling water circulation hole is connected with the cooling water outlet of the front cover through a connection pipe, and a second side of the cooling water circulation hole is connected with a water pump through the flow pipe.

4. A dry vacuum pump comprising:

a first cylinder, a second cylinder and a third cylinder;

a front cover and a rear cover in a tier-structure, wherein said first cylinder, said second cylinder and said third cylinder are installed between said front cover and said rear cover in a tiered-structure;

an intermediate cover being formed between the first and the second cylinders;

a pair of main screws being installed in the first cylinder for compressing and discharging a gas of a vacuum facility;

a rotor being formed in the second cylinder for drawing, compressing, and discharging the gas compressed by the main screws;

at least one circular shaped gas flow path, said at least one gas flow path being formed between the intermediate cover and the second cylinder for compressing and discharging the gas;

a motor housing engaging the front cover;

a cooling water inlet being formed within an outer surface of the rear cover of the dry vacuum pump;

a cooling water outlet being formed within the front cover;

a plurality of circular shaped cooling water flow paths being formed for guiding a cooling water pumped through the cooling water inlet to circulate in said cylinders and the intermediate cover, wherein at least one cooling water flow path is formed in an inner and an outer side of the circular shaped gas flow path formed in the rear cover and the intermediate cover;

a flow pipe, wherein the cooling water flow paths which are formed in the inner and outer sides of the gas flow path are connected by the flow pipe which passes through the gas flow path for thereby concurrently cooling the gas flow path; and a rotary shaft, wherein portions of the rotary shaft are capable of being cooled by the cooling water flow paths.

5. The dry vacuum pump according to claim 4, wherein threaded portions of the main screws are formed having multiple threads for thereby increasing a discharging speed of the gas pumped.

6. The dry vacuum pump according to claim 5, wherein the threaded portions of the main screws are double threaded.

7. The dry vacuum pump according to claim 5, wherein the threaded portions of the main screws are triple threaded.

8. The dry vacuum pump according to claim 4, further comprising a cooling water circulation hole being formed in an outer portion of the motor housing in a screw shape, wherein a first side of the cooling water circulation hole is connected with the cooling water outlet of the front cover through a connection pipe, and a second side of the cooling water circulation hole is connected with a water pump through the flow pipe.

9. The dry vacuum pump according to claim 8, wherein threaded portions of the main screws are formed having multiple threads for thereby increasing a discharging speed of the gas pumped.

10. The dry vacuum pump according to claim 9, wherein the threaded portions of the main screws are double threaded.

11. The dry vacuum pump according to claim 9, wherein the threaded portions of the main screws are triple threaded.

12. The vacuum pump according to claim 2, wherein the threaded portions of the main screws are double threaded.

13. The vacuum pump according to claim 2, wherein the threaded portions of the main screws are triple threaded.

14. The vacuum pump according to claim 3, wherein the threaded portions of the main screws are double threaded.

15. The vacuum pump according to claim 3, wherein the threaded portions of the main screws are triple threaded.

* * * * *